US010519955B2

(12) United States Patent
Ma et al.

(10) Patent No.: US 10,519,955 B2
(45) Date of Patent: Dec. 31, 2019

(54) CONNECTION STRUCTURE OF EXHAUST BEARING SEAT FOR COMPRESSOR AND SCREW COMPRESSOR

(71) Applicant: Gree Electric Appliances, Inc. of Zhuhai, Zhuhai (CN)

(72) Inventors: Bin Ma, Zhuhai (CN); Tianyi Zhang, Zhuhai (CN); Rihua Li, Zhuhai (CN); Hua Liu, Zhuhai (CN); Yushi Bi, Zhuhai (CN); Qiaoming Yang, Zhuhai (CN); Yanhai Peng, Zhuhai (CN); Kang Xu, Zhuhai (CN); Qiangjun Meng, Zhuhai (CN); Yungong Xu, Zhuhai (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 0 days.

(21) Appl. No.: 15/776,339

(22) PCT Filed: Oct. 26, 2016

(86) PCT No.: PCT/CN2016/103381
§ 371 (c)(1),
(2) Date: May 15, 2018

(87) PCT Pub. No.: WO2017/092524
PCT Pub. Date: Jun. 8, 2017

(65) Prior Publication Data

US 2018/0298906 A1 Oct. 18, 2018

(30) Foreign Application Priority Data

Nov. 30, 2015 (CN) ..... 2015 1 0860022

(51) Int. Cl.
*F03C 2/00* (2006.01)
*F03C 4/00* (2006.01)
(Continued)

(52) U.S. Cl.
CPC ..... *F04C 29/12* (2013.01); *F04C 15/06* (2013.01); *F04C 18/16* (2013.01); *F04C 29/026* (2013.01)

(58) Field of Classification Search
CPC ..... F04C 18/16; F04C 15/06; F04C 29/12; F04C 29/026
(Continued)

(56) References Cited

U.S. PATENT DOCUMENTS 6,045,344 A * 4/2000 Tsuboi ..... F04C 29/026 418/100
2004/0055773 A1 3/2004 Robbins
(Continued)

FOREIGN PATENT DOCUMENTS

CN 1896534 A 1/2007
CN 1979059 A 6/2007
(Continued)

*Primary Examiner* — Theresa Trieu
(74) *Attorney, Agent, or Firm* — The Webb Law Firm

(57) ABSTRACT

Disclosed is a connection structure of an exhaust bearing seat for compressors and screw compressors, designed to solve the problem of large radial vibration of the existing exhaust-end bearing seat. The connection structure includes an exhaust bearing seat, an oil separation bucket, and an oil separation screen assembly all arranged at an exhaust end of a body of the compressor, wherein a tail end of the exhaust bearing seat is connected with the oil separation screen assembly, and an outer periphery of the oil separation screen assembly is provided with a vibration-reducing element, which is connected to an inner wall of the oil separation bucket. The vibration of the exhaust bearing seat is transmitted to the vibration-reducing element through the oil separation screen assembly, and then to the oil separation bucket after being absorbed and suppressed by the vibration-reducing element.

10 Claims, 3 Drawing Sheets

(51) Int. Cl.

| | |
|---|---|
| ***F04C 2/00*** | (2006.01) |
| ***F04C 29/00*** | (2006.01) |
| ***F04C 29/12*** | (2006.01) |
| ***F04C 29/02*** | (2006.01) |
| ***F04C 18/16*** | (2006.01) |
| ***F04C 15/06*** | (2006.01) |

(58) Field of Classification Search
USPC ..... 418/201.1, 270, DIG. 1; 184/6.16–6.17
See application file for complete search history.

(56) References Cited

U.S. PATENT DOCUMENTS

2015/0337840 A1* 11/2015 Rockwood ..... F04C 29/063 418/1
2015/0345497 A1* 12/2015 Lucas ..... F04C 29/065 418/205
2018/0142689 A1* 5/2018 Chen ..... F04C 18/16 418/201.1

FOREIGN PATENT DOCUMENTS

| | | | |
|---|---|---|---|
| CN | 202140316 | U | 2/2012 |
| CN | 202203079 | U | 4/2012 |
| CN | 102661276 | A | 9/2012 |
| CN | 202560558 | U | 11/2012 |
| CN | 202707491 | U | 1/2013 |
| CN | 203756533 | U | 8/2014 |
| CN | 104963872 | A | 10/2015 |
| CN | 105386978 | A | 3/2016 |
| CN | 205277820 | U | 6/2016 |
| EP | 1331398 | A2 | 7/2003 |
| JP | 10318175 | A | 12/1998 |
| KR | 100625475 | B1 | 9/2006 |
| WO | 2015166580 | A1 | 11/2015 |

* cited by examiner

CONNECTION STRUCTURE OF EXHAUST BEARING SEAT FOR COMPRESSOR AND SCREW COMPRESSOR

CROSS-REFERENCE TO RELATED APPLICATIONS

This application is the United States national phase of International Application No. PCT/CN2016/103381 filed Oct. 26, 2016, and claims priority to Chinese Patent Application No. 201510860022.X filed Nov. 30, 2015, the disclosures of which are hereby incorporated in their entirety by reference.

BACKGROUND OF THE INVENTION

Field Of The Invention

The present disclosure relates to the field of compressors, and in particular to a connection structure of an exhaust bearing seat for a compressor and a screw compressor.

Description Of Related Art

An exhaust-end bearing seat, as an important casting of a screw compressor, not only functions to support a rotor, but also acts as an exhaust channel of the compressed gas.

However, during operation of the screw compressor, the intermittent opening/closing of the exhaust port generates a complex gas pulsation, and the gas pulsation acts on the bearing seat to cause high frequency vibration of the latter, which is disadvantageous to stable operation of the rotor. As shown in FIG. 1, a tail portion of an exhaust-end bearing seat 2' connected with a body 1' of the screw compressor is connected to an oil separation screen 4' through a spacer pipe 8', such that vibration of the bearing seat 2' causes the oil separation screen 4' to vibrate. The oil separation screen 4' becomes very heavy due to high content of lubricating oil, and suspension of the heavy oil separation screen 4' on the tail portion of the bearing seat 2' cause greater vibration of the bearing seat 2'.

The above-mentioned connection structure of the bearing seat is equivalent to suspension of a large mass at the tail portion of the bearing seat 2' (the oil separation screen 4' contains heavy oil). Although the oil separation screen 4' is in contact with an oil separation bucket 3', as the oil separation screen 4' is very soft, it does not play a load-bearing role; instead, it increases the radial vibration displacement of the bearing seat 2'. Such connection structure of the bearing seat causes a variety of hazards, such as reduced service life of the bearing due to misalignment, scratch of the rotor and slide valves, abnormal noise of the screw compressor, and even machine run-down and motor burnout, etc.

SUMMARY OF THE INVENTION

An object of the present disclosure is to provide a connection structure of an exhaust bearing seat that reduces the radial vibration of the exhaust-end bearing seat.

Another object of the present disclosure is to provide a screw compressor with a small radial vibration at the exhaust-end bearing seat, long service life and wide application scope.

The present disclosure proposes the following technical solution in some embodiments:

The present disclosure provides in some embodiments a connection structure of an exhaust bearing seat for a compressor, comprising an exhaust bearing seat, an oil separation bucket, and an oil separation screen assembly all arranged at an exhaust end of a body of the compressor, wherein a tail end of the exhaust bearing seat is connected with the oil separation screen assembly, and a vibration-reducing element is provided between the oil separation screen assembly and the oil separation bucket.

As an alternative embodiment, the vibration-reducing element is provided on an outer periphery of the oil separation screen assembly and is connected with an inner wall of the oil separation bucket.

As an alternative embodiment, the vibration-reducing element is provided with a cavity.

As an alternative embodiment, the vibration-reducing element is made of a plastic material provided therein with a plurality of cavities communicating with one another.

As an alternative embodiment, the plastic material includes rubber.

As an alternative embodiment, a support is provided on at least one side of the oil separation screen assembly, and the vibration-reducing element is connected to the support and the oil separation screen assembly.

Further, a porous support plate is provided on at least one side of the oil separation screen assembly, and the vibration-reducing element is fitted over an outer periphery of the porous support plate and the oil separation screen assembly.

Further, the porous support plate is in an interference fit with the vibration-reducing element.

Further, materials of the porous support plate comprise steel, iron, or aluminum alloy.

Further, a retaining ring is provided on the inner wall of the oil separation bucket and is connected to the vibration-reducing element.

Further, wherein the vibration-reducing element includes an annular sheathing portion, and a connection portion is formed by radially inward extension of an end of the annular sheathing portion towards the retaining ring; the annular sheathing portion is fitted over the outer periphery of the oil separation screen assembly, and the connection portion is connected with the retaining ring.

Further, a tail end of the exhaust bearing seat is connected with the oil separation screen assembly through a spacing mechanism, which is adapted to maintain a certain distance between the exhaust bearing seat and the oil separation screen assembly.

Further, the spacing mechanism comprises a screw rod, and a spacer pipe disposed between the tail end of the exhaust bearing seat and the oil separation screen assembly, wherein the screw rod penetrates through the oil separation screen assembly and is threadedly connected in the spacer pipe.

On the other hand, the present disclosure proposes the following technical solution in some embodiments:

The present disclosure provides in another embodiment a screw compressor, which is provided with any one of the connection structure of an exhaust bearing seat for a compressor as stated above.

The embodiments of the present disclosure are beneficial in that:

In the connection structure of an exhaust bearing seat for a compressor provided in embodiments of the present disclosure, the tail end of the exhaust bearing seat is connected with the oil separation screen assembly, and the oil separation screen assembly is connected to the oil separation bucket through the vibration-reducing element provided on its outer periphery. In this way, vibration of the exhaust bearing seat is transmitted to the vibration-reducing element through the oil separation screen assembly, and then to the oil separation bucket after being absorbed by the vibration-reducing element, which is equivalent to exerting an elastic support on the exhaust bearing seat, thereby capable of obviously suppressing radial vibration of the tail portion of the exhaust bearing seat, improving the rotor to rotate stably, and avoiding the problems of scratch of the rotor, abnormal noise of the compressor and the like.

In the screw compressor provided in embodiments of the present disclosure, owing to the adoption of the above-mentioned connection structure of an exhaust bearing seat for a compressor, the radial vibration at the exhaust-end bearing seat is reduced, the rotor rotates more stably, and the compressor is rendered with longer service life and wider application scope.

DESCRIPTION OF THE INVENTION

The technical solution of the present disclosure will be further described as below in combination with the drawings through the specific embodiments.

Figure 1:
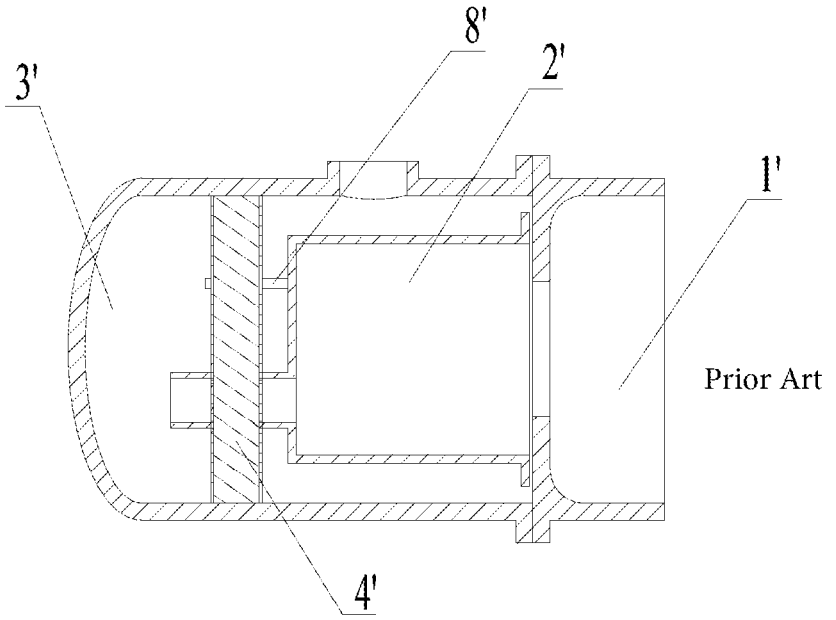
FIG. 1 is a schematic view of a connection structure of an exhaust bearing seat for a compressor in the related techniques.
Figure 2:
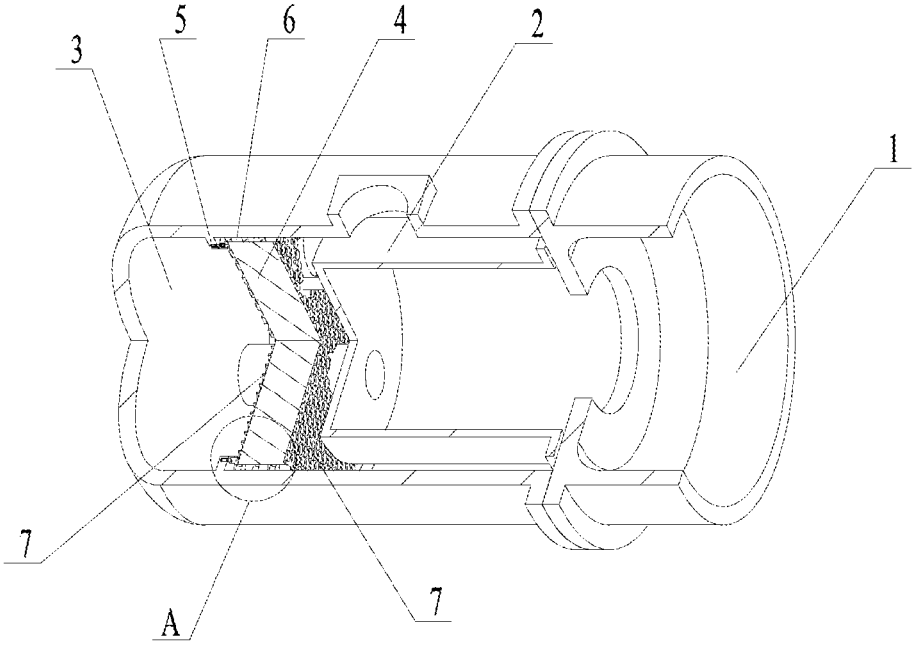
FIG. 2 is a perspective view of a connection structure of an exhaust bearing seat for a compressor in some embodiments of the present disclosure.

The present embodiment provides a connection structure of an exhaust bearing seat for a compressor, which as shown in FIGS. 2-5, comprises an exhaust bearing seat 2, an oil separation bucket 3, and an oil separation screen assembly 4 all arranged at an exhaust end of a body 1 of the compressor. Referring to FIG. 2, a tail end of the exhaust bearing seat 2 is connected with the oil separation screen assembly 4, and an outer periphery of the oil separation screen assembly 4 is provided with a vibration-reducing element 6, which is connected with an inner wall of the oil separation bucket 3.

The exhaust bearing seat 2, the oil separation bucket 3, and the oil separation screen assembly 4 are all arranged at the exhaust end of the body 1 of the compressor. Specifically, the exhaust bearing seat 2 is disposed at the exhaust end of the body 1 of the compressor, the oil separation screen assembly 4 is connected with the tail end of the exhaust bearing seat 2, and the vibration-reducing element 6 on the outer periphery of the oil separation screen assembly 4 is connected with the inner wall of the oil separation bucket 3. Taking the direction shown in FIG. 4 as an example, gas is discharged into a left chamber of the oil separation bucket 3 via an exhaust pipe 10, then turns back and passes through a porous support plate 7 and is finally discharged through an exhaust port on a housing of the oil separation bucket 3.

In an alternative or preferred embodiment, a vibration-reducing element 6 is provided between the oil separation screen assembly 4 and the oil separation bucket 3. The specific structural forms and position of the vibration-reducing element 6 is arranged in various means.

In some embodiments, the vibration-reducing element 6 has a ring structure or other structures. One or more vibration-reducing elements 6 are provided.

In an alternative or preferred embodiment, the vibration-reducing element 6 is provided with cavities 63 for reducing vibration. The individual cavities 63 communicate or not communicate with each other, and have identical or different structures.

In some embodiments, the vibration-reducing element 6 is disposed between the outer periphery of the oil separation screen assembly 4 and the inner wall of the oil separation bucket 3. The vibration-reducing element 6 is fixed to either of the oil separation screen assembly 4 and the oil separation bucket 3 and is in tight-fitting with the other one, or is fixed to both of them, or detachably connected to both of them.

In the present embodiment, the tail end of the exhaust bearing seat 2 is connected with the oil separation screen assembly 4, and the oil separation screen assembly 4 is connected to the oil separation bucket 3 through the vibration-reducing element 6 provided on its outer periphery. In this way, vibration of the exhaust bearing seat 2 is transmitted to the vibration-reducing element 6 through the oil separation screen assembly 4, and then to the oil separation bucket 3 after being absorbed by the vibration-reducing element 6, which is equivalent to exerting an elastic support on the exhaust bearing seat 2, thereby capable of obviously suppressing radial vibration of the tail portion of the exhaust bearing seat 2, improving the rotor to rotate stably, and avoiding the problems of scratch of the rotor, abnormal noise of the compressor and the like.

As an alternative embodiment, the vibration-reducing element 6 is made of a rubber material provided therein with a plurality of cavities 63 communicating with one another. The cavities 63 of the porous rubber are equivalent to damping cavities 63, which further serve to attenuate the radial vibration displacement. Of course, the vibration-reducing element 6 is not limited to the above-mentioned material, and is made of other materials having an appropriate vibration reducing effect, such as rubber.

In some embodiments, the vibration-reducing element 6 has a honeycomb structure. The vibration-reducing element 6 is made of rubber, spring steel or other materials having vibration reducing effect.

As an alternative embodiment, a support is provided exteriorly to at least one side of the oil separation screen assembly 4, and the vibration-reducing element 6 is connected to the support and the oil separation screen assembly. The support has a variety of structural forms.

Figure 4:
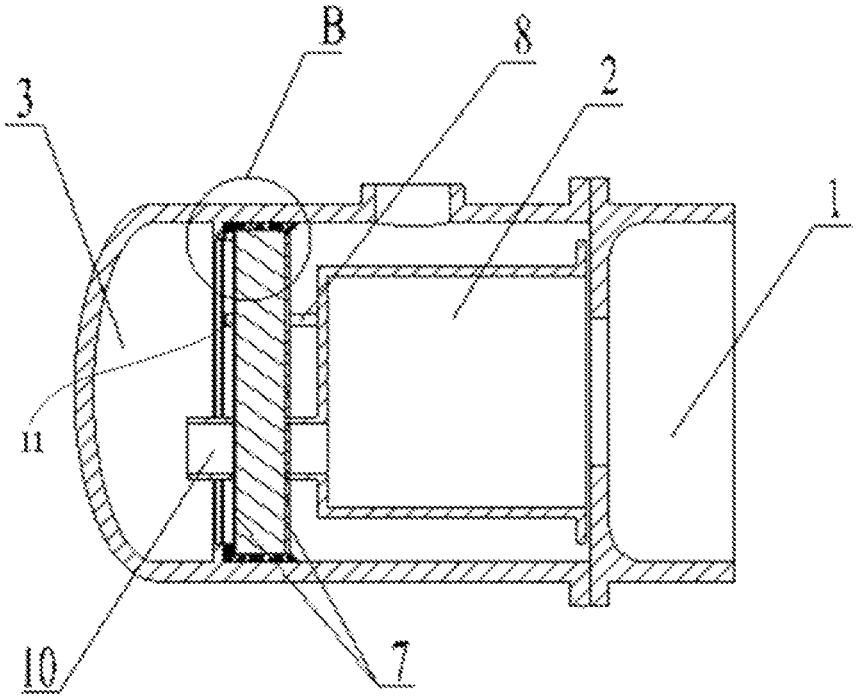
FIG. 4 is a sectional view of the connection structure of an exhaust bearing seat for a compressor in the embodiment of the present disclosure.
Figure 5:
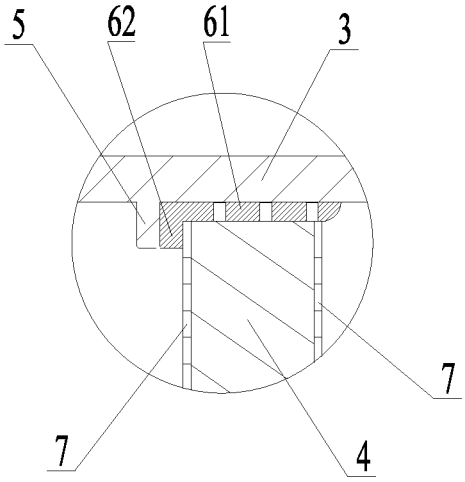
FIG. 5 is a locally enlarged view of B in FIG. 4.

As a further embodiment, referring to FIG. 4 and FIG. 5, the porous support plate 7 is provided on both sides of the oil separation screen assembly 4, and the vibration-reducing element 6 is fitted over the outer periphery of the porous support plate 7 and the oil separation screen assembly 4.

The porous support plate 7 not only serves to support and fix the oil separation screen assembly 4, but more importantly, transmits more effectively the vibration of the oil separation screen assembly 4 to the vibration-reducing element 6.

In some embodiments, the porous support plate 7 is provided exteriorly to both sides of the oil separation screen assembly 4, or is provided exteriorly to only one side of the oil separation screen assembly 4.

Referring to FIG. 4 and FIG. 5, the porous support plate 7 is provided with pores that penetrate in a thickness direction of the support plate 7, and two or more of the pores are provided.

Referring to FIG. 4 and FIG. 5, alternatively, at least one of the porous support plates 7 is in interference fit with the vibration-reducing element 6 so as to transmit vibration more effectively.

In addition, alternatively, the porous support plate 7 is closely attached to the outside of the oil separation screen assembly 4. The porous support plate 7 is closely attached to the surface of the oil separation screen assembly 4, and the two porous support plates 7 sandwich the oil separation screen assembly 4 in between.

More specifically, the porous support plate 7 is a porous steel plate, but it is not limited to a porous steel plate and is made of other materials having an appropriate hardness, such as iron, aluminum alloy, or the like. The porous support plate 7 made of steel plate material is convenient for drawing and processing of materials.

In one or more embodiments, they are also optional to provide the porous supporting plate 7 exteriorly to one side of the oil separation screen assembly 4, and bring the porous supporting plate 7 into interference fit with the vibration-reducing element 6.

Figure 3:
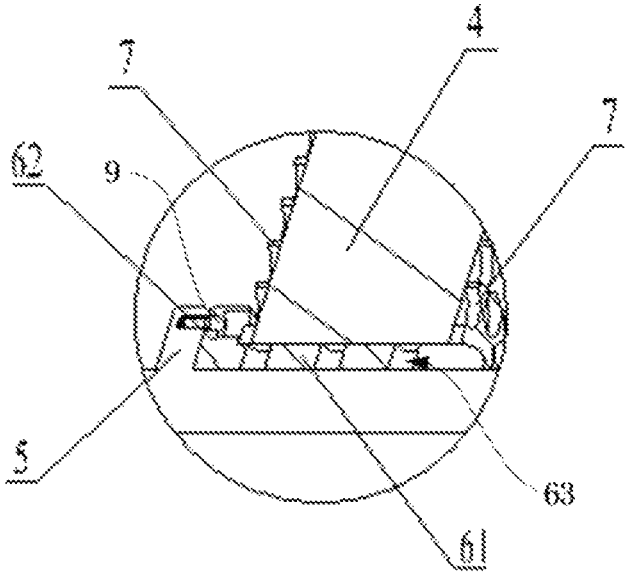
FIG. 3 is a locally enlarged view of A in FIG. 2.

Further, as shown in FIG. 3 and FIG. 5, the inner wall of the oil separation bucket 3 is provided with a retaining ring 5, to which the vibration-reducing element 6 is connected.

More specifically, the vibration-reducing element 6 includes an annular sheathing portion 61, and a connection portion 62 formed by radially inward extension of the annular sheathing portion 61 towards an end of the retaining ring 5. The annular sheathing portion 61 is adapted to be fitted over the outer periphery of the oil separation screen assembly 4, and the connection portion 62 is adapted to be connected to the retaining ring 5.

The vibration-reducing element 6 includes the annular sheathing portion 61 and the connection portion 62, and the connection portion 62 is formed by radially inward extension of the annular sheathing portion 61 towards an end of the retaining ring 5. The vibration-reducing element 6 with such structural form is an integrated structure, which is compact and easy to install.

In some embodiments, the retaining ring 5 is integrally formed with the oil separation bucket 3, or is fixed to the oil separation bucket 3 by welding or the like.

The height of the retaining ring 5 is set as actually required, and the connection portion 62 is connected to the retaining ring 5 through a screw 9, a bolt or the like.

In addition, in the present disclosure, it is also possible to connect the vibration-reducing element 6 and the oil separation bucket 3 by providing at least two annularly-distributed baffle units on the inner wall of the oil separation bucket 3.

As some embodiments, the tail end of the exhaust bearing seat 2 is connected with the oil separation screen assembly 4 through a spacing mechanism, which is adapted to maintain a predetermined distance between the exhaust bearing seat 2 and the oil separation screen assembly 4.

More specifically, the spacing mechanism includes a screw rod 11, and a spacer pipe 8 disposed between the exhaust bearing seat 2 and the oil separation screen assembly 4. The screw rod 11 is used for penetrating through the oil separation screen assembly 4 to be threadedly connected in the spacer pipe 8 such that the oil separation screen assembly 4 is connected to the tail end of the exhaust bearing seat 2.

In some embodiments where the porous support plate 7 is provided, the screw rod 11 penetrates through the porous support plate 7 and the oil separation screen assembly 4 in order before being threadedly connected in the spacer pipe 8, thereby fixing the porous support plate 7 and the oil separation screen assembly 4 together. In addition, the porous support plate 7 and the oil separation screen assembly 4 is also separately connected by means of other connectors. In some embodiments, the number of the spacer pipe 8 and the screw rod 11 is set as actually required.

Figure 6:
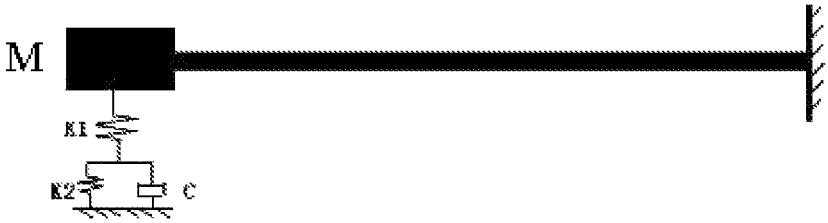
FIG. 6 is a schematic principle view in the embodiment of the present disclosure.

The working principle of some embodiments is as follows: FIG. 6 shows a simplified model of the connection structure of an exhaust bearing seat for a compressor provided in some embodiments, in which the exhaust bearing seat 1 is equivalent to a cantilever beam, the oil separation screen assembly 4 is equivalent to a mass M, the porous support plate 7 is stiffness K1, and the vibration-reducing element 6 is equivalent to parallel-connection treatment of stiffness K2 and damping C; thus, it is equivalent to adding a vibration-reducing device between the exhaust bearing seat 1 and the oil separation bucket 2; the radial vibration of the exhaust bearing seat is effectively reduced by properly designing M, K1, K2 and C.

The present disclosure provides in some embodiments a screw compressor, which is provided with the connection structure of an exhaust bearing seat for a compressor as described in some embodiments.

In the screw compressor provided in some embodiments of the present disclosure, owing to the adoption of the above-mentioned connection structure of an exhaust bearing seat for a compressor, the radial vibration at the exhaust-end bearing seat is reduced, the rotor rotates more stably, and the compressor is rendered with longer service life and wider application scope.

The technical principle of the present disclosure has been described above with reference to specific embodiments. These descriptions are intended only to explain the principle of the present disclosure and are not interpreted in any way as limiting the scope of protection of the present disclosure. Based on the explanation herein, those skilled in the art envisage other specific embodiments of the present disclosure without involving any inventive effort, and all of these embodiments fall into the protection scope of the present disclosure.

The invention claimed is:

1. A connection structure of an exhaust bearing seat for a compressor, comprising the exhaust bearing seat, an oil separation bucket, and an oil separation screen assembly all arranged at an exhaust end of a body of the compressor, wherein a tail end of the exhaust bearing seat is connected with the oil separation screen assembly, a vibration-reducing element is provided between the oil separation screen assembly and the oil separation bucket, and the vibration-reducing element is provided on an outer periphery of the oil separation screen assembly and is connected with an inner wall of the oil separation bucket;

wherein a porous support plate is provided on at least one side of the oil separation screen assembly, and the vibration-reducing element is fitted over an outer periphery of the porous support plate and the oil separation screen assembly.

2. The connection structure of the exhaust bearing seat for the compressor according to claim 1, wherein the vibration-reducing element is provided with a cavity, the vibration-reducing element is made of a plastic material provided therein with a plurality of cavities communicating with one another, and the plastic material comprises rubber.

3. The connection structure of the exhaust bearing seat for the compressor according to claim 1, wherein a support is provided on at least one side of the oil separation screen assembly, and the vibration-reducing element is connected to the support and the oil separation screen assembly.

4. The connection structure of the exhaust bearing seat for the compressor according to claim 1, wherein the porous support plate is in an interference fit with the vibration-reducing element.

5. The connection structure of the exhaust bearing seat for the compressor according to claim 4, wherein materials of the porous support plate comprise steel, iron, or aluminum alloy.

6. The connection structure of the exhaust bearing seat for the compressor according to claim 1, wherein a retaining ring is provided on an inner wall of the oil separation bucket and is connected to the vibration-reducing element.

7. The connection structure of the exhaust bearing seat for the compressor according to claim 6, wherein the vibration-reducing element comprises an annular sheathing portion, a connection portion is formed by radially inward extension of an end of the annular sheathing portion towards the retaining ring, the annular sheathing portion is fitted over the outer periphery of the oil separation screen assembly, and the connection portion is connected with the retaining ring.

8. The connection structure of the exhaust bearing seat for the compressor according to claim 1, wherein the tail end of the exhaust bearing seat is connected with the oil separation screen assembly through a spacing mechanism, which is adapted to maintain a certain distance between the exhaust bearing seat and the oil separation screen assembly.

9. The connection structure of the exhaust bearing seat for the compressor according to claim 8, wherein the spacing mechanism comprises a screw rod and a spacer pipe, the spacer pipe disposed between the tail end of the exhaust bearing seat and the oil separation screen assembly, and wherein the screw rod penetrates through the oil separation screen assembly and is threadedly connected in the spacer pipe.

10. A screw compressor comprising the connection structure of the exhaust bearing seat for the compressor according to claim 1.

* * * * *